US005555469A

United States Patent [19]

Ishikawa et al.

[11] Patent Number: 5,555,469

[45] Date of Patent: Sep. 10, 1996

[54] IMAGE FORMING APPARATUS HAVING TONER RECYCLING DEVICE WITH ELECTROSTATIC CONVEYOR

[75] Inventors: Fumihiko Ishikawa; Seiji Oka, both of Yokohama; Tsukuru Kai, Fujisawa, all of Japan

[73] Assignee: Ricoh Company, Ltd., Tokyo, Japan

[21] Appl. No.: 323,573

[22] Filed: Oct. 17, 1994

Related U.S. Application Data

[63] Continuation of Ser. No. 955,432, Oct. 2, 1992, abandoned.

[51] Int. Cl.[6] ..... G03G 21/00

[52] U.S. Cl. ..... 355/298

[58] Field of Search ..... 355/215, 298, 355/304; 118/652; 209/128

[56] References Cited

U.S. PATENT DOCUMENTS

| | | | |
|---|---|---|---|
| 3,654,901 | 4/1972 | Donohue et al. . | |
| 3,778,678 | 12/1973 | Masuda | 361/233 |
| 3,914,046 | 10/1975 | Tanaka et al. . | |
| 4,054,381 | 10/1977 | Bernhard | 355/298 X |
| 4,377,334 | 3/1983 | Nishikawa | 355/298 X |
| 4,389,968 | 6/1983 | Satomura | 118/652 |
| 4,423,950 | 1/1984 | Sagami | 355/298 |
| 4,527,884 | 7/1985 | Musser . | |
| 4,610,534 | 9/1986 | Ito et al. | 355/304 |
| 4,647,179 | 3/1987 | Schmidlin | 355/262 |
| 4,705,387 | 11/1987 | Lin | 355/303 |
| 4,752,810 | 6/1988 | Schmidlin et al. | 355/303 |
| 4,875,081 | 10/1989 | Goffe et al. | 355/303 |

FOREIGN PATENT DOCUMENTS

| | | | |
|---|---|---|---|
| 0064280 | 4/1982 | Japan | 355/298 |
| 0079980 | 5/1982 | Japan | 355/298 |
| 0151985 | 9/1982 | Japan | 355/298 |
| 0137972 | 8/1984 | Japan | 355/298 |
| 61-77881 | 4/1986 | Japan . | |
| 0267985 | 11/1988 | Japan | 355/298 |

*Primary Examiner*—Robert Beatty

*Attorney, Agent, or Firm*—Oblon, Spivak, McClelland, Maier & Neustadt, P.C.

[57] ABSTRACT

An image forming apparatus of the type collecting a toner remaining on the surface of an image carrier after image transfer and returning it to a developing unit to use it again. The apparatus separates the toner from paper dust and other impurities before returning the toner to the developing unit on the basis of differences in charge, weight and volume between the toner and the impurities. The toner is returned via an eletrostatic conveyor.

8 Claims, 6 Drawing Sheets

IMAGE FORMING APPARATUS HAVING TONER RECYCLING DEVICE WITH ELECTROSTATIC CONVEYOR

This application is a continuation of application Ser. No. 07/955,432, filed on Oct. 2, 1992, now abandoned.

BACKGROUND OF THE INVENTION

The present invention relates to a copier, facsimile transceiver, printer or similar image forming apparatus and, more particularly, to an image forming apparatus capable of removing impurities from a toner collected from the surface of an image carrier by a cleaning unit before the toner is returned from the cleaning unit to a developing unit.

One of image forming apparatuses extensively used today has an image carrier, a developing unit, an image transferring unit, and a cleaning unit. The developing unit develops a latent image electrostatically formed on the image carrier by a toner. The resulting toner image is transferred from the image carrier to a recording medium by the image transferring unit. The cleaning unit collects the toner remaining on the surface of the image carrier after the image transfer. The collected toner is returned to the developing unit by transporting means to be reused. The problem with this type of image forming apparatus is that the toner collected from the image carrier by the cleaning unit contains paper dust and other impurities. Specifically, such impurities are introduced in the toner while the toner is agitated, charged and transferred from a developing roller, or developer carrier, to the image carrier in the developing unit and transferred from the image carrier to the recording medium in the image transferring unit, while the recording medium is separated from the image carrier, and while the image carrier is cleaned after the image transfer, When use is made of a two-component developer, i.e., a mixture of a toner and a carrier, even the carrier exists in the collected toner as an impurity. The impurities admixed with the toner often scratch the developing roller and adversely effect an image when returned to the developing unit together with the toner.

SUMMARY OF THE INVENTION

It is therefore an object of the present invention to provide an image forming apparatus capable of removing impurities from toner collected from an image carrier before the toner is returned to a developing unit.

An image forming apparatus of the present invention comprises an image carrier for forming an electrostatic latent image thereon, a developing unit for developing the latent image by supplying a toner to the image carrier to thereby produce a toner image, an image transferring unit for transferring the toner image from the image carrier to a recording medium, a cleaning unit for collecting the toner remaining on the surface of the image carrier after image transfer, a toner transporting device for transporting the toner collected by the cleaning unit is to the developing unit, and an electrostatic actuator located on a path along which the toner collected by the cleaning unit is transported to the developing unit by the toner transporting device for generating electric fields which transport only particles of the toner carrying a predetermined charge in a predetermined direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
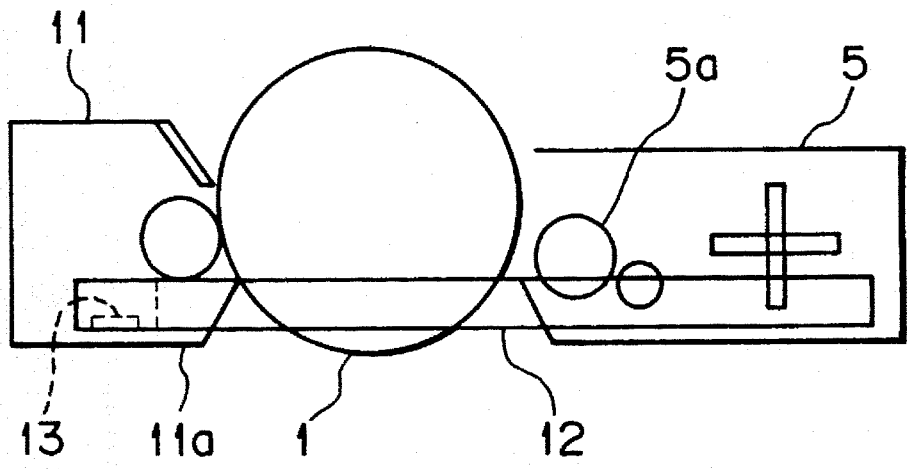
FIG. 1 is a fragmentary front view of an image forming apparatus embodying the present invention and implemented as a copier.
Figure 2:
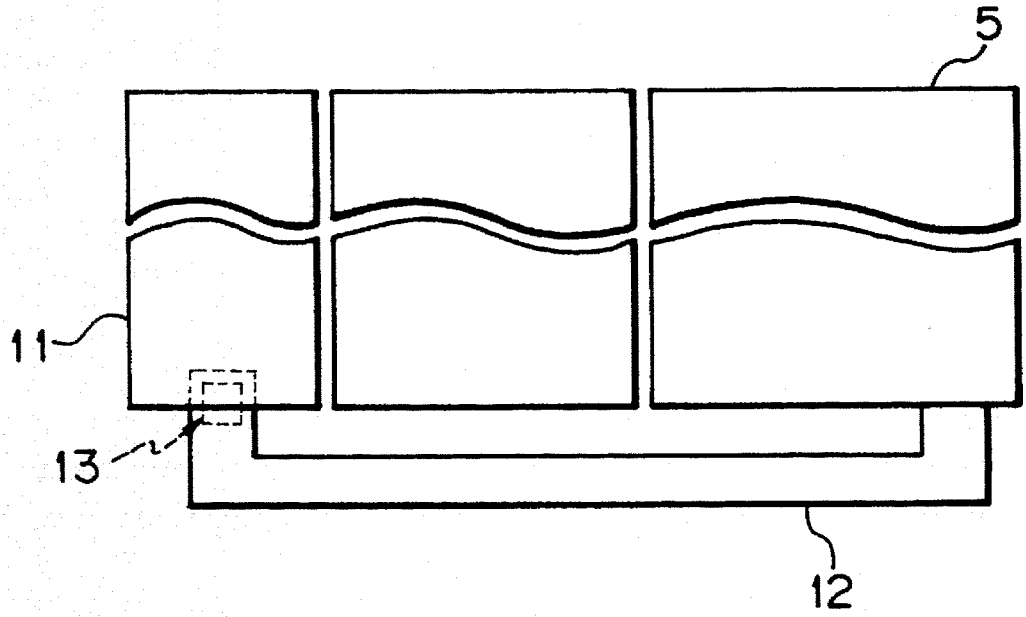
FIG. 2 is a plan view of the arrangement shown in FIG. 1.
Figure 7:
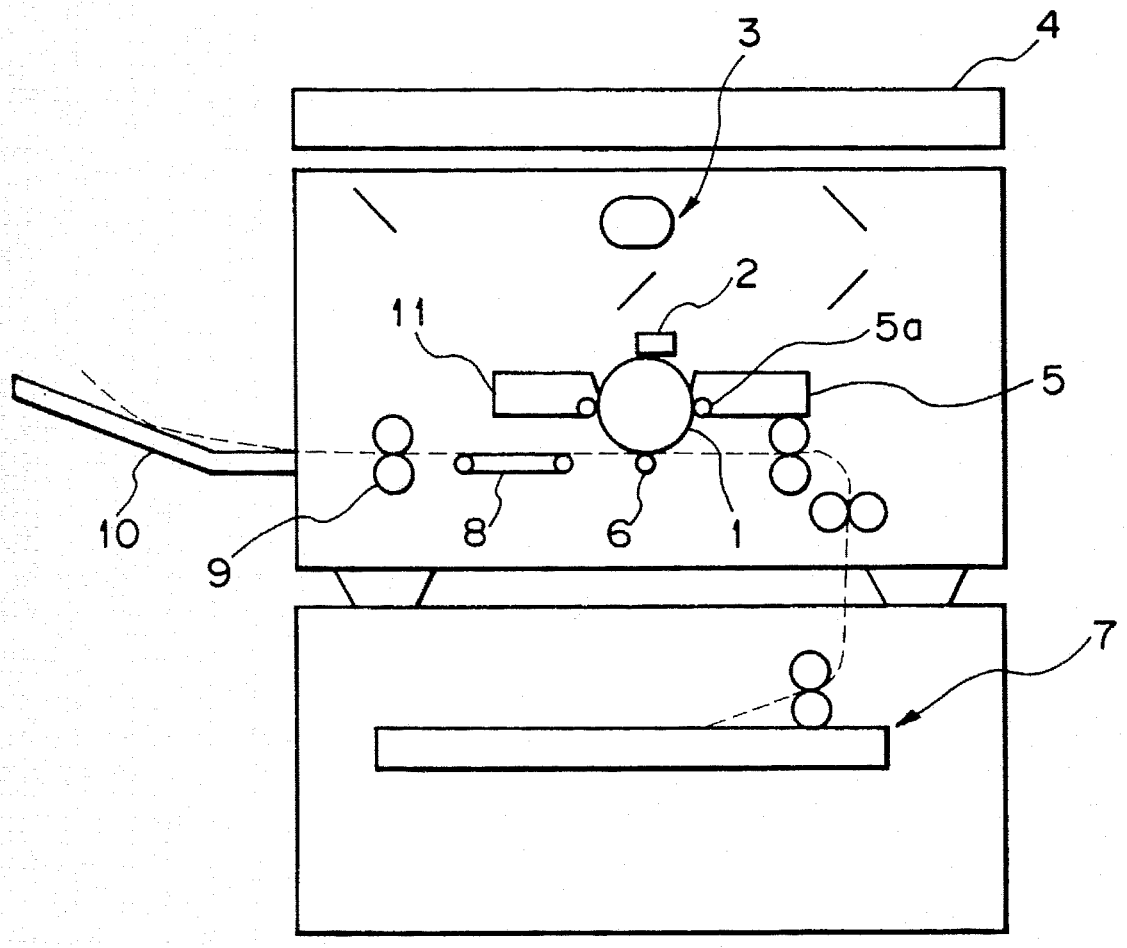
FIG. 7 is a front view showing the general construction of the embodiment.

Referring to FIG. 1 of the drawings, an image forming apparatus embodying the present invention is shown and implemented as an electrophotographic copier by way of example. To begin with, the general construction of the copier will be described with reference to FIG. 7. As shown, the copier has an image carrier in the form of a photoconductive drum 1 which is rotatable clockwise. While a document is transported by a document feeder 4, a charger 2 and optics 3 form an electrostatic latent image representative of the document on the surface of the drum. A developing unit 5 has a developing roller 5*a* for developing the latent image by a toner. An image transferring unit 6 transfers the resulting toner image from the drum 1 to a recording medium, e.g., a paper sheet fed from a paper feeding unit 7. The paper sheet carrying the toner image is separated from the drum 1, transported to a fixing unit 9 by a belt 8 to have the image fixed thereon, and then driven out of the copier to a tray 10. The toner remaining on the drum 1 after the image transfer is collected by a cleaning unit 11. As shown in FIGS. 1 and 2, a piping 12 communicates the cleaning unit 11 to the developing unit 5 and accommodates a coil or similar conveyor therein. Hence, the toner collected by the cleaning unit 11 is returned by the conveyor to the developing unit 5 via the piping 12.

Figure 3:
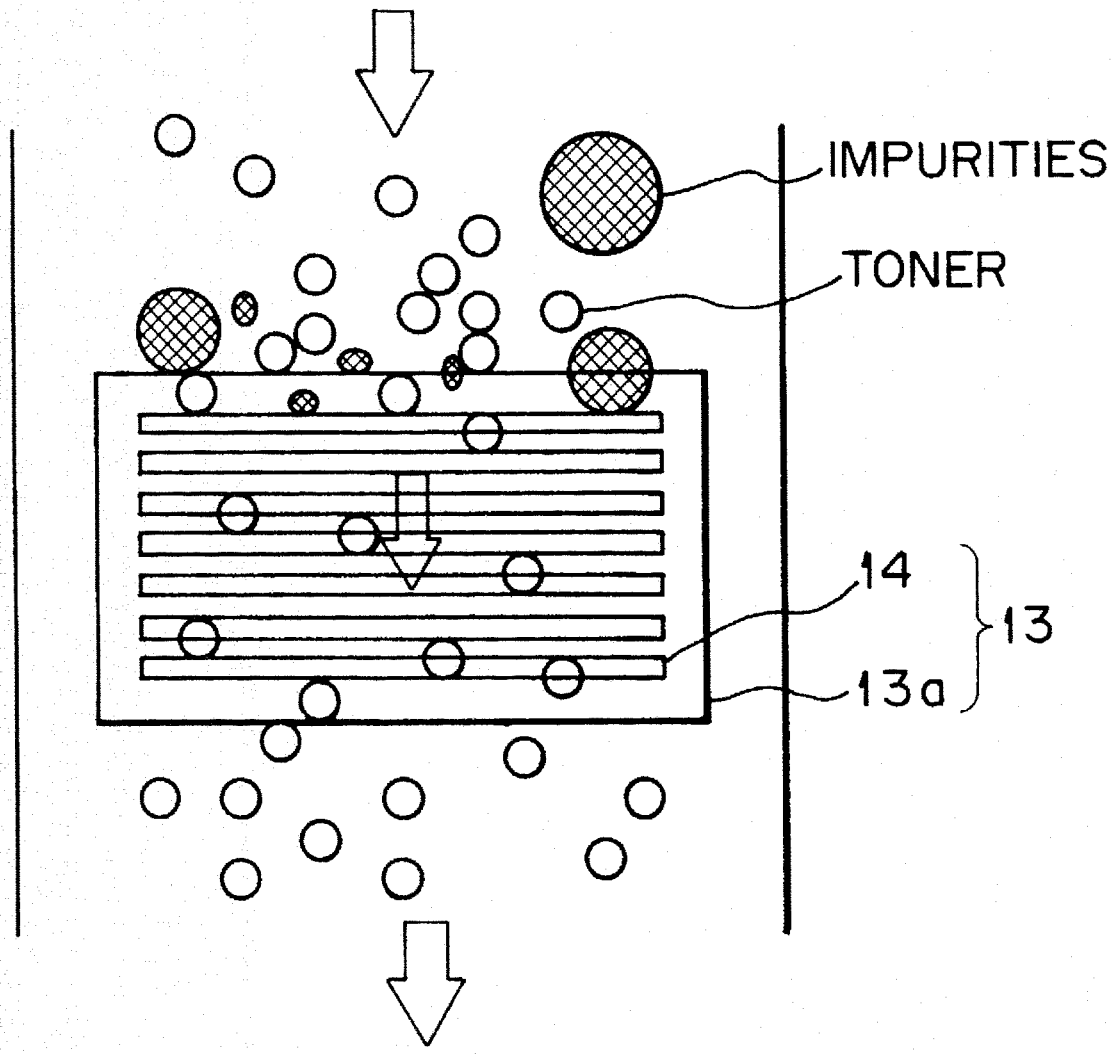
FIG. 3 is a view demonstrating how an electrostatic actuator included in the embodiment removes impurities.
Figure 4A:
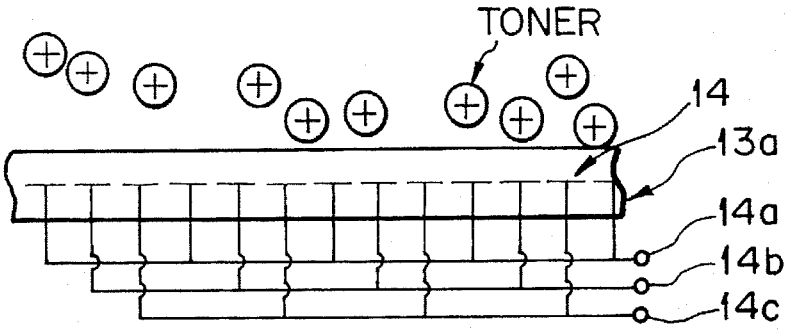
FIGS. 4A–4F are views representative of the principle of toner transport by the electrostatic actuator.

An implementation for transporting only the toner from the cleaning unit 11 to the developing unit 5 will be described. In the illustrative embodiment, an electrostatic actuator 13 is located at the position where the piping 12 is connected to the cleaning unit 11. As shown in FIGS. 1 and 2, the electrostatic actuator, or simply actuator as referred to hereinafter, 13 extends from the bottom wall 11*a* of the casing of the cleaning unit 11 to the lower portion of the piping 12 adjoining the above-mentioned position. As shown in FIG. 3, the actuator 13 is made up of a stationary block 13*a* made of an insulating material, and a plurality of electrodes, or drive electrodes, 14 buried in the block 13*a*. The drive electrodes 14 each has a narrow stripe-like configuration extending in a direction perpendicular to the direction of toner transport. As shown in FIG. 4A, nearby drive electrodes 14 are each connected to different one of a first to a third electrode terminal 14*a*–14*c*, whereby three drive electrode groups are formed. It is to be noted that the drive electrodes 14 are fully buried in the stationary block 13*a* and not visible in practice, although they are indicated by solid lines in FIG. 3 for illustration purpose.

Preferably, the drive electrodes 14 are each provided with a width of, for example, 10–20 microns and spaced apart from adjoining ones by a distance of 10–20 microns. This will allow toner particles whose size is about 10 microns to deposit on each drive electrode 14 substantially in a single row. Voltages are applied to the electrode terminals 14–14*c*, as will be described. Then, the charge of the toner and that of the drive electrodes 14 generate driving forces for transporting the toner.

Figure 4B:
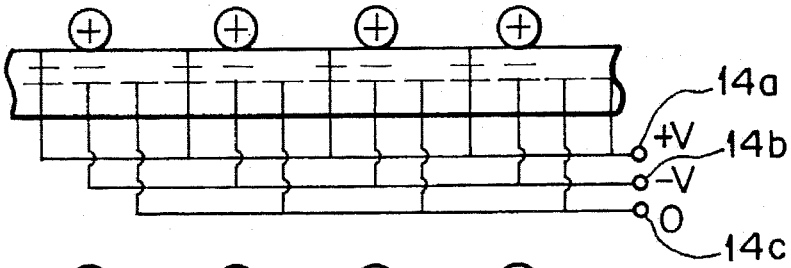

Referring to FIGS. 4A–4F, how the actuator 13 transports positively charged toner particles to, for example, the right as viewed in the figures will be described. As shown in FIG. 4A, while a voltage is not applied to any of the electrode terminals 14*a*–14*c*, no charge is deposited on the drive electrodes Although a charge of positive polarity is deposited on each toner particle due to agitation, the toner particles are not effected by the drive electrodes 14 at all since the stationary block 13*a* is not charged. In this condition, the toner particles remain on the block 13*a* due to gravity and are not transported. Assume that a positive voltage, a negative voltage and zero volt are respectively applied to the first, second and third electrode terminals 14*a*–14*c*, as shown in FIG. 4B. Then, the toner particles are attracted by the drive electrodes opposite in polarity thereto, i.e., deposited on the surface of the block 13*a* above the drive electrodes 14 to which the negative voltage is applied. The other drive electrodes 14 to which the positive voltage and zero volt are applied do not attract the toner particles.

Figure 4C:
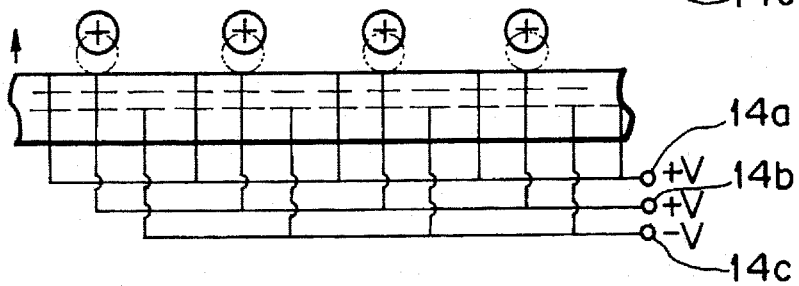

Subsequently, as shown in FIG. 4C, the positive voltage identical in polarity with the toner particles is applied to the second drive electrode group disposed beneath the toner particles, the negative voltage opposite in polarity to the toner particles is applied to the third drive electrode group adjoining the second group in the direction of toner transport (rightward in the figures), and the positive voltage is also applied to the first drive electrode group adjoining the second group in the direction opposite to the direction of toner transport. As a result, the charge of the toner and that of the drive electrodes beneath the toner become the same in polarity, generating repulsive forces. This causes the toner particles to rise or float away from the stationary block 13*a*. Since the charge of the third drive electrode group is of the opposite polarity to the toner particles, this drive electrode group attracts the toner particles floating at the upper left-hand side thereof. At the same time, since the charge of the first drive electrode group is of the same polarity as the toner, this electrode group repulses the toner particles floating at the upper right-hand side thereof. Consequently, forces act on the toner particles to drive them to the right. Then, the toner particles move a distance substantially equal to the pitch of the drive electrodes. At this instant, the friction between the toner particles and the surface of the block 13*a* is small due to the floating forces.

Figure 4D:
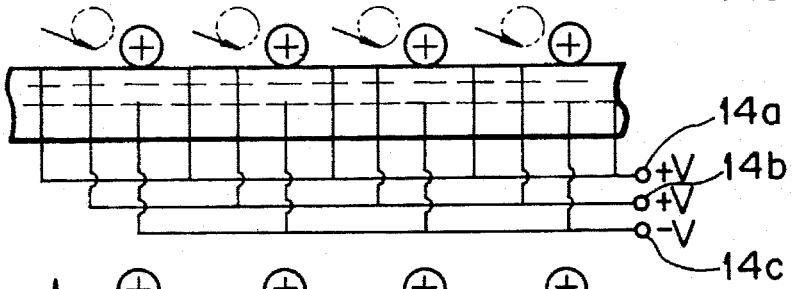
Figure 4E:
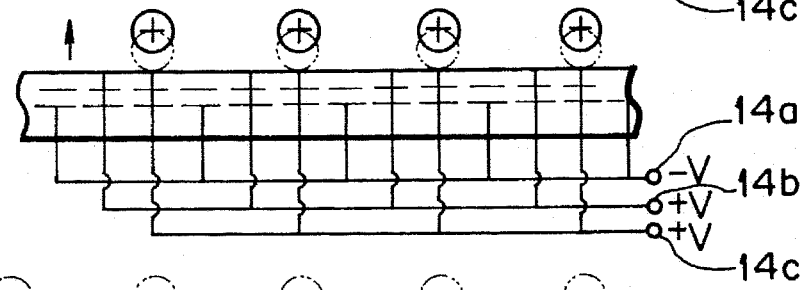
Figure 4F:
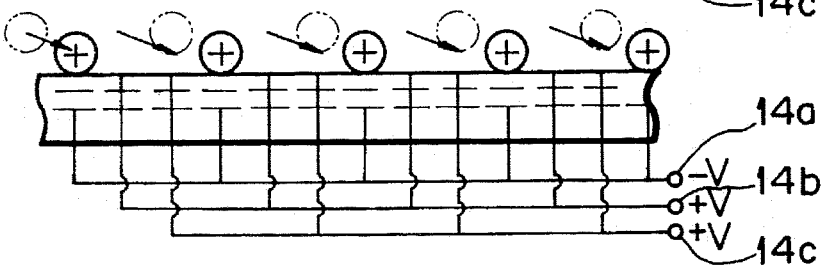

Then, the voltages are switched over as shown in FIGS. 4E and 4F in order to shift the voltage patterns (FIGS. 4C and 4D) for repulsing and driving the toner particles by one. Such a procedure is repeated to move the toner particles continuously.

The switchover of the voltage application to the first to third drive electrode groups shown in FIGS. 4B–4F and the subsequent switchover are shown in Table 1 below.

TABLE 1

| ELECTRODE GROUP | I | → | II | → | III | → | IV | → | ONWARD |
|---|---|---|---|---|---|---|---|---|---|
| 1ST GROUP | +V | → | +V | → | −V | → | +V | → | I–IV REPEATED |
| 2ND GROUP | −V | → | +V | → | +V | → | −V | → | I–IV REPEATED |
| 3RD GROUP | 0 | → | −V | → | +V | → | +V | → | I–IV REPEATED |

In Table 1, a step I corresponds to FIG. 4B, a step II corresponds to FIGS. 4C and 4D, and a step III corresponds to FIGS. 4E and 4F. A step IV applies the positive voltage, negative voltage and positive voltage to the first to third drive electrode groups, respectively, and is shifted one step from the step III to the right, i.e., in the direction of toner transport. The steps II–IV are repeated thereafter to shift the repulsing and driving patterns one at a time.

It is to be noted that in FIG. 4C (step II) the toner particles will be driven in the other direction if the positive voltage and the negative voltage are applied to the third electrode group and the first electrode group, respectively.

In the above construction, the toner collected by the cleaning unit 11 is brought to the end of the stationary block 13*a* of the actuator 13 adjoining the position where the tubing 12 is connected to the cleaning unit 11. This is effected by a coil or similar conveyor, not shown, or by the inclination of the bottom wall 11*a* of the casing of the cleaning unit 11. By the above-described principle of the actuator 13, only the toner is transported on and along the block 13*a* and then handed over to the screw or similar conveyor accommodated in the piping 12. On the other hand, paper dust and other impurities which are not charged are left in the cleaning unit 11 without being transported by the actuator 13. Likewise, the carrier charged to the opposite polarity to the toner is left in the cleaning unit 11. As a result, only the toner of predetermined polarity is returned to the developing unit 5 by the conveyor disposed in the piping 12.

Experiments were conducted with the illustrative embodiment in which the developing unit 5 used a dry one-component developer, i.e., toner. It was found that the embodiment produces even 5,000 copies without any deterioration. This was not achievable with a copier lacking the actuator 13.

The size of the charged toner particles which the actuator 13 can transport may be changed by changing the width of each drive electrode 14 and the distance between nearby drive electrodes 14. Specifically, assume that the particles are charged, but extremely small compared to the above-mentioned width and distance. Then, such particles are not effected by the drive electrode 14 adjoining the electrode 14 on which they deposited first, i.e., they simply move up and down on the latter electrode 14. This is advantageous in that deteriorated toner particles, e.g., those broken up during use are also left in the cleaning unit 11 and not reused by the developing unit 5, eliminating damage ascribable to such broken pieces.

Further, carrier particles, for example, are heavier than the toner particles and, therefore, moved only at a low speed despite the electric fields of the drive electrodes 14. Hence, if the voltages to be applied to the drive electrodes 14 and the switching period thereof are selected to match the toner transport, the moving speed of the carrier particles will be sufficiently low even when they receive a transporting force in the same direction as the toner particles.

Figure 5:
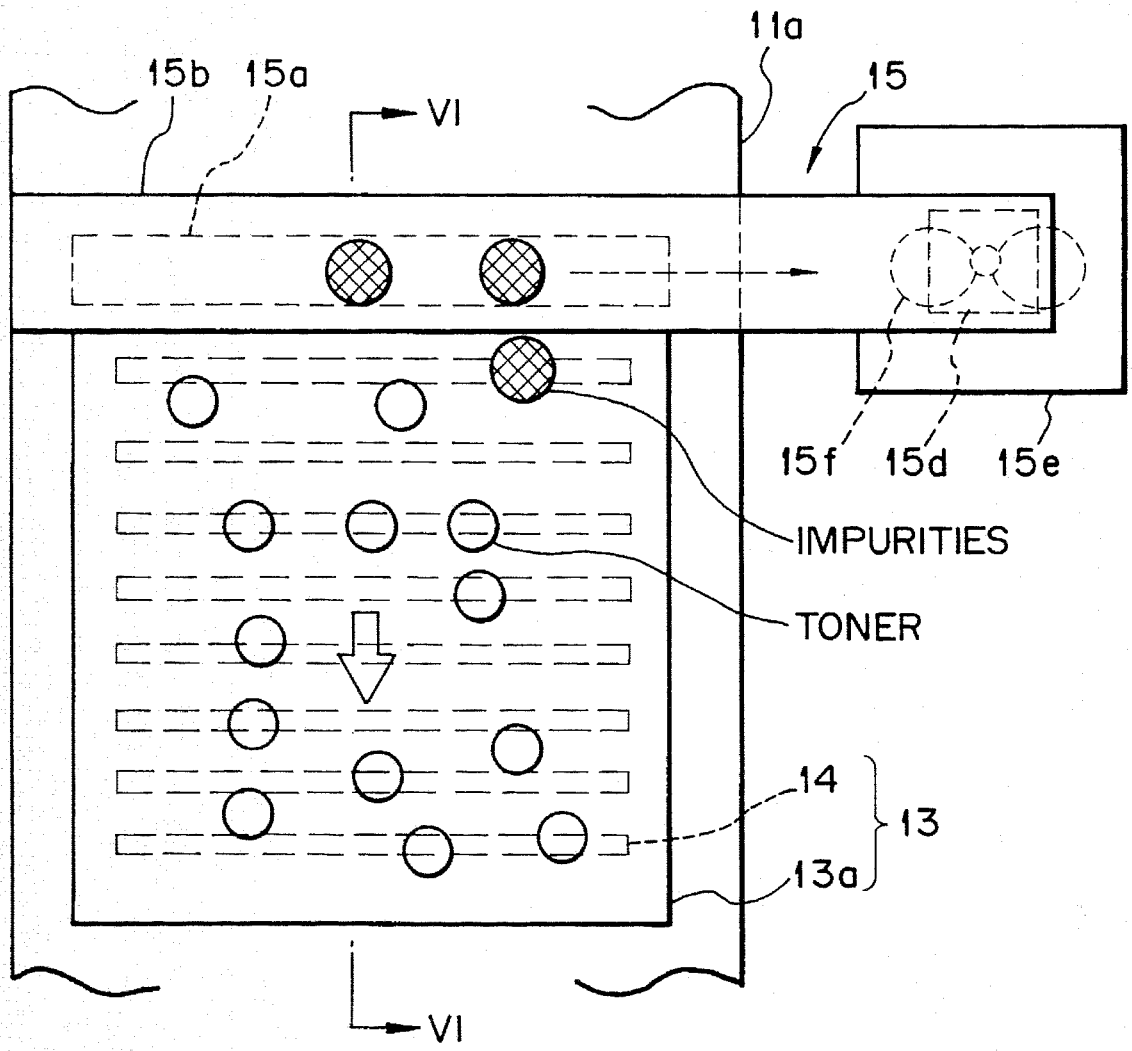
FIG. 5 is a plan view of the electrostatic actuator and a dust collector also included in the embodiment.
Figure 6:
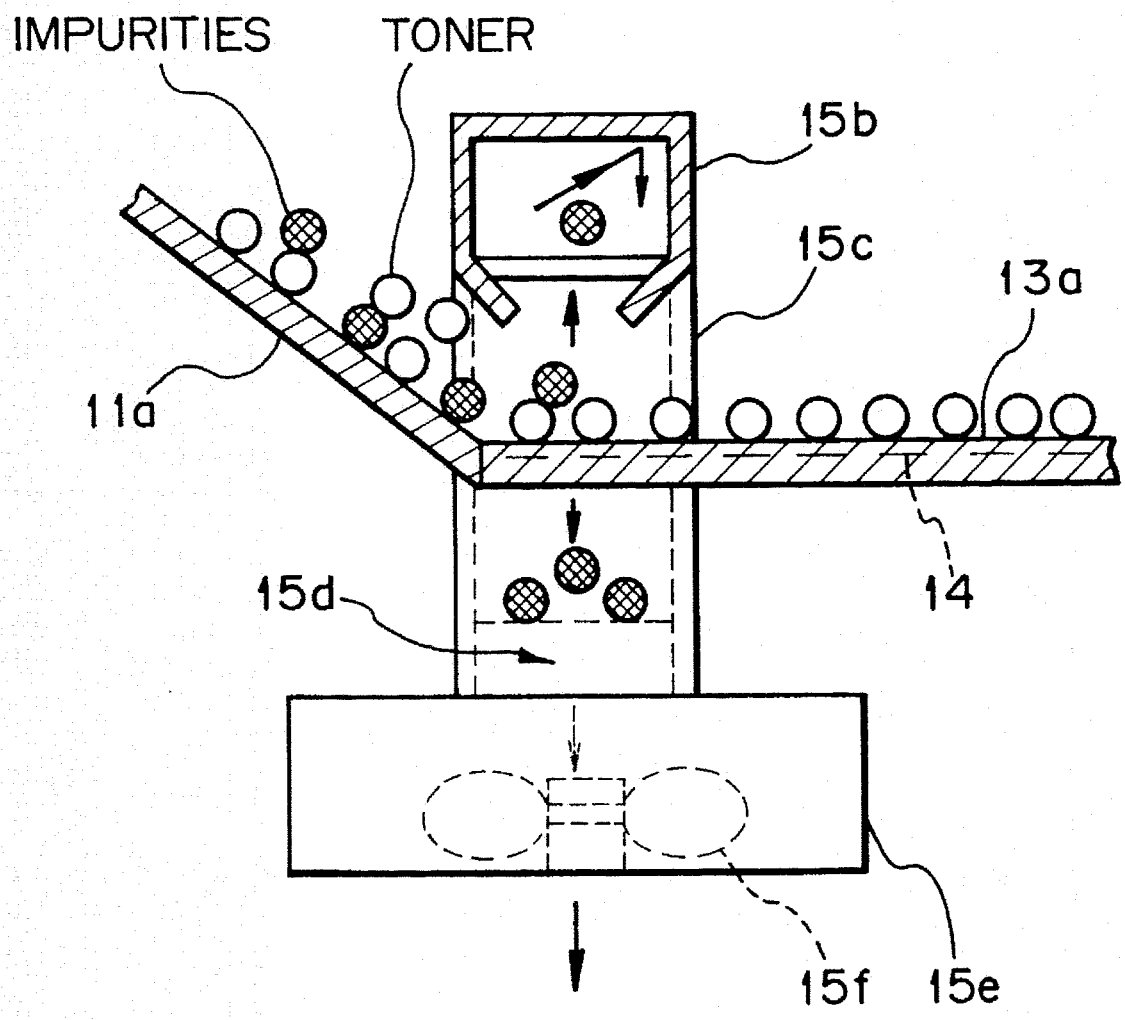
FIG. 6 is a fragmentary section along line VI—VI of FIG. 5.

The impurities, e.g., paper dust without a charge and carrier particles opposite in polarity to the toner particles are left in the cleaning device 11 without being transported by the actuator 13, as stated above. As shown in FIGS. 5 and 6, the copier may be provided with a dust collector 15 for collecting the impurities in a predetermined location. FIG. 5 shows the actuator 13 and dust collector 15 in a plan view while FIG. 6 shows them in a fragmentary section along line VI—VI of FIG. 5. In these figures, the top and side casing of the cleaning unit is not shown for simplicity. Further, in FIG. 5, part of the fixed body 13 and part of the drive electrodes 14 which are located beneath the dust collector 15 are not shown. The dust collector 15 is made up of a parallel duct 15*b* having a suction opening 15*a* at the underside thereof, a vertical duct 15*c*, a dust filter 15*d*, a fan accommodating section 15*e*, and a fan 15*f*. The suction opening 15*a* is located above the upstream end of the actuator 13 which adjoins the casing bottom wall 11*a*. As shown in FIGS. 5 and 6, the parallel duct 15*b* is closed at the left end thereof and communicated to the vertical duct 15*c* at the right end thereof. The fan accommodating section 15*e* is communicated to the lower end of the vertical duct 15*c*. The fan 15*f* is rotated to generate a stream of air for sucking impurities via the opening 15*a*. An opening, not shown, is formed through the bottom of the fan accommodating section 15*e*.

In FIGS. 5 and 6, by the inclination of the casing bottom wall 11*a*, the collected toner containing paper dust and other impurities are brought to the end of the stationary block 13 of the actuator 13 adjoining the portion where the piping 12 is connected. Then, only the toner is conveyed on and along block 13*a* of the actuator 13 by the previously stated principle downward as viewed in FIG. 5 or rightward as viewed in FIG. 6. Such a toner is handed over to the screw or similar conveyor disposed in the piping 12. On the other hand, the impurities not transported by the actuator 13 are sucked into the parallel duct 15*b* via the suction opening 15*a* by the fan 15*f* and then propagated through the duct 15*b* to the fight as viewed in FIG. 5 Subsequently, the impurities are guided downward, as viewed in FIG. 6, by the vertical duct 15*c* to be collected by the dust filter 15*d*. As a result, the impurities are prevented from accumulating at the upstream end of the actuator 13 in an excessive amount, allowing only the toner to be transported stably by the actuator 13. The stream of air from which the impurities have been removed is discharged via the bottom of the fan accommodating section 15*e*.

In the illustrative embodiment, the actuator 13 is located at the position where the cleaning unit 11 and the piping 12 adjoin each other. Alternatively, the actuator 13 may be bodily received in the cleaning unit 11, so that only the toner may be handed over to the piping 12.

Further, the actuator 13 may even extend over the entire piping 12 to convey the toner to the developing unit 5.

In summary, it will be seen that the present invention provides an image forming apparatus which prevents a developing roller or similar image carrier thereof from being damaged by impurities and insures desirable image quality despite the reuse of a toner. This is because during the return of a toner collected from an image carrier only the toner particles carrying a predetermined charge are conveyed in a predetermined direction to a developing unit by electric fields while impurities are not transported to the developing unit.

An electrostatic actuator for generating the above electric fields may be at least partly disposed in a cleaning unit so as to retain the impurities in the cleaning unit. This is successful in using the interior of the cleaning unit as an impurity storage.

Moreover, when a dust collector is provided for sucking and collecting the impurities not transported by the actuator in a predetermined position, the impurities are prevented from depositing in an excessive mount at the upstream end of the actuator 13. Then, the actuator 13 is allowed to transport only the toner stably.

Various modifications will become possible for those skilled in the art after receiving the teachings of the present disclosure without departing from the scope thereof.

What is claimed is:

1. An image forming apparatus comprising:

an image carrier for carrying an electrostatic latent image thereon;

a developing unit for developing the latent image by supplying a toner to said image carrier to thereby produce a toner image;

an image transferring unit for transferring the toner image from said image carrier to a recording medium;

a cleaning unit for collecting the toner remaining on a surface of said image carrier after image transfer;

toner transporting means for transporting the toner collected by said cleaning unit to said developing unit;

an electrostatic actuator having a plurality of parallel spaced electrodes located in and along a path which the toner collected by said cleaning unit is transported to said developing unit by said toner transporting means for generating electric fields which transport only particles of the toner carrying a predetermined charge in a predetermined direction;

means to remove, from said path, particles other than said toner; and means to selectively activate said parallel spaced electrodes by selectively applying thereto at least three respective charging voltages, including a positive voltage, a negative voltage, and a ground voltage, so as to provide an electromotive force to said particles of toner such that said force is the primary force used in moving said particles.

2. An apparatus as claimed in claim 1, wherein said electrostatic actuator is at least partly disposed in said cleaning unit.

3. An apparatus as claimed in claim 1, further comprising a dust collector located in close proximity to said electrostatic actuator for collecting impurities other than the particles of the toner carrying the predetermined potential in a predetermined location by sucking said impurities.

4. An image forming method comprising the steps of:

developing an electrostatic latent image formed on an image carrier by supplying a toner to said carrier, transferring a resulting toner image to a recording medium, collecting the toner remaining on said image carrier after image transfer, and reusing the collected toner for development of a latent image to be formed on said image carrier, transporting said collected toner for reuse, wherein only particles of said toner carrying a predetermined charge are transported by applying thereto a plurality of charging voltages, including a positive voltage, a negative voltage, and a ground voltage, to provide the primary motive force to transport said particles mainly in a predetermined direction; and removing from said path any remaining non-toner particles that are not transported.

5. An image forming apparatus comprising:

an image carrier for carrying an electrostatic latent image thereon;

a developing unit for developing the latent image by supplying a toner to said image carrier to thereby produce a toner image;

an image transferring unit for transferring the toner image from said image carrier to a recording medium;

a cleaning unit for collecting any toner remaining on the surface of said image carrier after said image transfer;

toner transporting means for transporting the toner collected by said cleaning unit to said developing unit;

an electrostatic actuator having a plurality of parallel spaced electrodes which are arranged side by side and with each of said parallel electrodes extending perpendicular to a direction of toner transport and placed on a path along which the toner collected by said cleaning unit is transported to said developing unit by said toner transporting means, wherein said actuator generates electric fields for transporting only the particles of toner carrying a predetermined charge and in a predetermined direction; and means to selectively activate said parallel spaced electrodes by selectively applying thereto at least three respective charging voltages, including a positive voltage, a negative voltage, and a ground voltage, so as to provide an electromotive force to said particles of toner such that said force is the primary force used in moving said particles.

6. An apparatus as in claim 5, wherein the space between the plurality of parallel spaced electrodes is greater than the diameter of toner particles which are to be transported.

7. An apparatus as in claim 5, wherein said electrostatic actuator is located inside a pipe.

8. An image forming apparatus comprising:

an image carrier for carrying an electrostatic latent image thereon;

a developing unit for developing a latent image by supplying a toner to said image carrier to thereby produce a toner image;

an image transferring unit for transferring the toner image from said image carrier to a recording medium;

a cleaning unit for collecting the toner remaining on the surface of said image carrier after image transfer;

toner transporting means for transporting the toner collected by said cleaning unit to said developing unit;

an electrostatic actuator having a plurality of parallel space electrodes located in and along a path which the toner collected by said cleaning unit is transported to said developing unit by said toner transporting means and further comprising a means by which a positive voltage, a negative voltage, and a ground voltage are respectively applied to a first, second and third electrode group of said plurality of parallel space electrodes and further and subsequent to said application of voltages a positive voltage is applied to an electrode in the second drive electrode group and a negative voltage opposite in polarity of the toner particles is applied to an electrode in the third group adjoining said second group of electrodes of said parallel spaced electrodes at the same time that a positive voltage is applied to the first drive electrode group which adjoins the second group such that the first group adjoins the second group in the direction opposite to that of the direction of toner transport;

means to remove, from said path, particles other than said toner.

* * * * *

UNITED STATES PATENT AND TRADEMARK OFFICE

CERTIFICATE OF CORRECTION

PATENT NO. : 5,555,469

DATED : September 10, 1996

INVENTOR(S) : Fumihiko ISHIKAWA, et al.

It is certified that error appears in the above-indentified patent and that said Letters Patent is hereby corrected as shown below:

On the title page, add item [30], the Foreign Application Priority Data. It should read:

-- Oct. 4, 1991 [JP] Japan.....3-285601

May 20, 1992 [JP] Japan.....4-154490 .--

Signed and Sealed this

Seventeenth Day of December, 1996

*Attest:*

*Attesting Officer*

Bruce Lehman

BRUCE LEHMAN

*Commissioner of Patents and Trademarks*